US007758205B2

(12) United States Patent
Liu

(10) Patent No.: US 7,758,205 B2
(45) Date of Patent: Jul. 20, 2010

(54) FLASHLIGHT

(76) Inventor: Yun-Zhao Liu, No. 3, 2nd St., Hsinfeng Rd., Huangpu Township, Zhongshan City, Guangdong Province (CN)

( * ) Notice: Subject to any disclaimer, the term of this patent is extended or adjusted under 35 U.S.C. 154(b) by 170 days.

(21) Appl. No.: 12/222,188

(22) Filed: Aug. 5, 2008

(65) Prior Publication Data

US 2010/0033962 A1 Feb. 11, 2010

(51) Int. Cl.
*F21L 4/04* (2006.01)

(52) U.S. Cl. ..... 362/202; 362/800; 362/196; 362/197

(58) Field of Classification Search ..... 362/202–206, 362/188, 194, 196, 197
See application file for complete search history.

(56) References Cited

U.S. PATENT DOCUMENTS 5,475,575 A * 12/1995 Chin-Hsiang ..... 362/203
6,183,106 B1 * 2/2001 Thummel et al. ..... 362/188
6,682,203 B2 * 1/2004 Shiau ..... 362/202
6,966,677 B2 * 11/2005 Galli ..... 362/373
2005/0237738 A1 * 10/2005 Shiau ..... 362/202
2006/0039139 A1 * 2/2006 Maglica et al. ..... 362/202

* cited by examiner

*Primary Examiner*—Sandra L O'Shea
*Assistant Examiner*—Leah S Lovell
(74) *Attorney, Agent, or Firm*—Rosenberg, Klein & Lee

(57) ABSTRACT

A flashlight includes a lamp support, an electric light-generating mechanism in the lamp support, a covering member around the lamp support, a barrel body joined on the covering member, and an adjustment member; the adjustment member is threadedly joined in the lamp support, and can be turned to adjust a position of a focal point of light emitted from a light source of the light-generating mechanism; front and rear heat-conducting components are positioned on front and rear ends of the light-generating mechanism respectively, and they contact the lamp support and the barrel body respectively; heat produced from functioning of the light-generating mechanism will be conducted away from the front heat-conducting component to the lamp support and from the rear heat-conducting component to the barrel body, and the light source is prevented from being damaged by the heat produced from it continuing shining for an extended length of time.

9 Claims, 4 Drawing Sheets

FLASHLIGHT

BACKGROUND OF THE INVENTION

1. Field of the Invention

The present invention relates to a flashlight, more particularly one, which is structured in such a manner that waste heat produced from shining of the light source can be efficiently conducted away, and the user is allowed to adjust a position of a focal point of light emitted from the light source.

2. Brief Description of the Prior Art

High-power light emitting diodes (LED) have been developed, and gain popularity for household illumination and emergency illumination. Flashlights are among the common emergency illumination devices.

Such emergency flashlights have relatively high intensity owing to the high-power light emitting diodes. However, the high-power light emitting diodes will produce a large amount of waste heat when they are shining. The light emitting diodes will become very hot and less efficient, and can even get damaged if the waste heat isn't effectively dissipated. Moreover, commercially available flashlights can't be adjusted in the position of the focal point of light emitted therefrom according to the users' needs.

Therefore, it is a main object of the present invention to provide an improvement on a flashlight to overcome the above problems.

SUMMARY OF THE INVENTION

A flashlight in accordance with an embodiment of the present invention includes a lamp support, an electric light-generating mechanism in the lamp support, a covering member around the lamp support, a barrel body joined on the covering member, a power supply held in the barrel body, and an adjustment member. The adjustment member is threadedly joined in the lamp support, and can be turned to adjust a position of a focal point of light emitted from a light source of the light-generating mechanism. Front and rear heat-conducting components are positioned on front and rear ends of the light-generating mechanism respectively, and they contact the lamp support and the barrel body respectively; when the light source is shining, heat produced by the electric light-generating mechanism will be conducted away from the front heat-conducting component to the lamp support as well as from the rear heat-conducting component to the barrel body. Therefore, the light source is prevented from being damaged by the heat produced from it continuing shining for an extended length of time.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
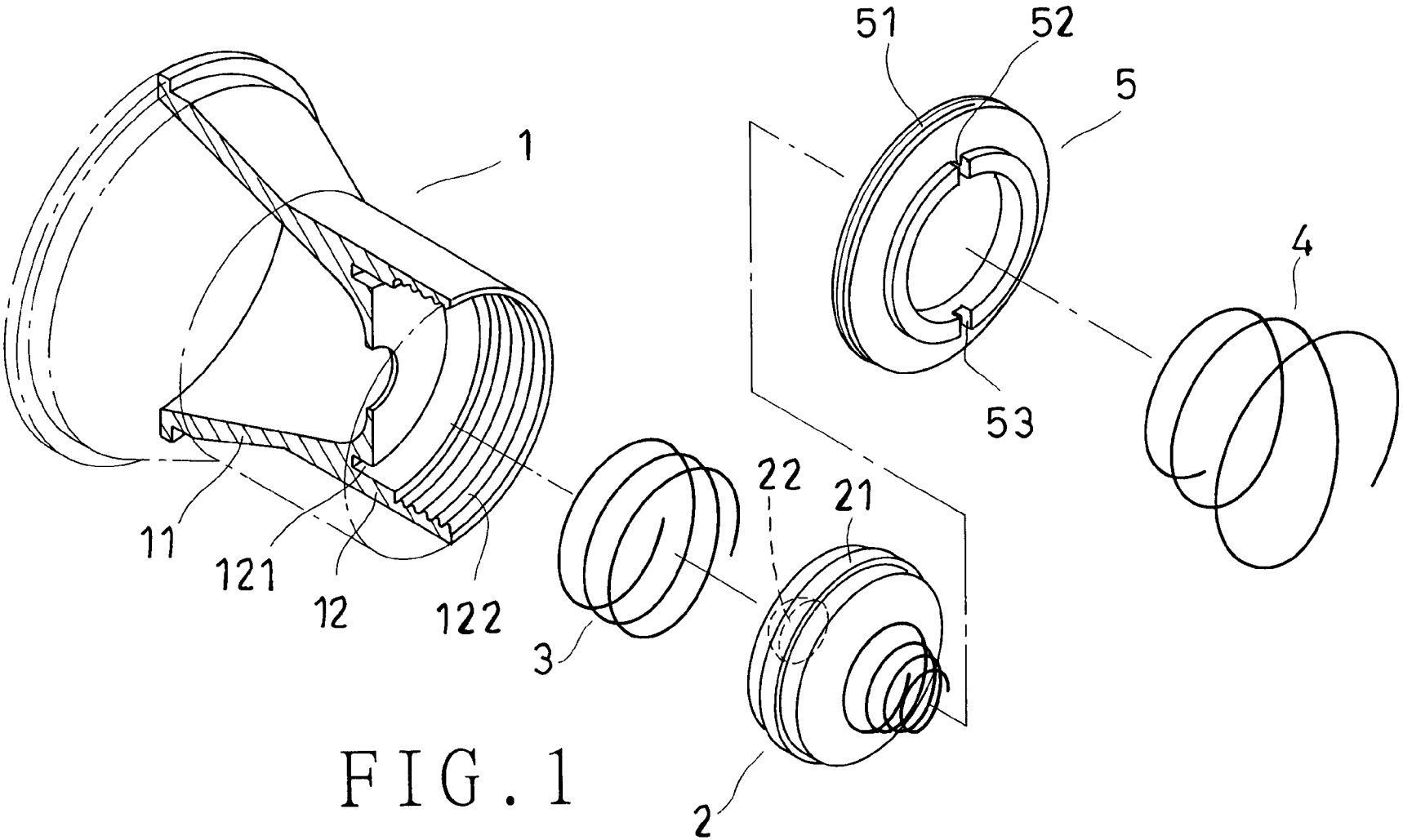
FIG. 1 is a fragmentary exploded perspective view of the present invention.
Figure 2:
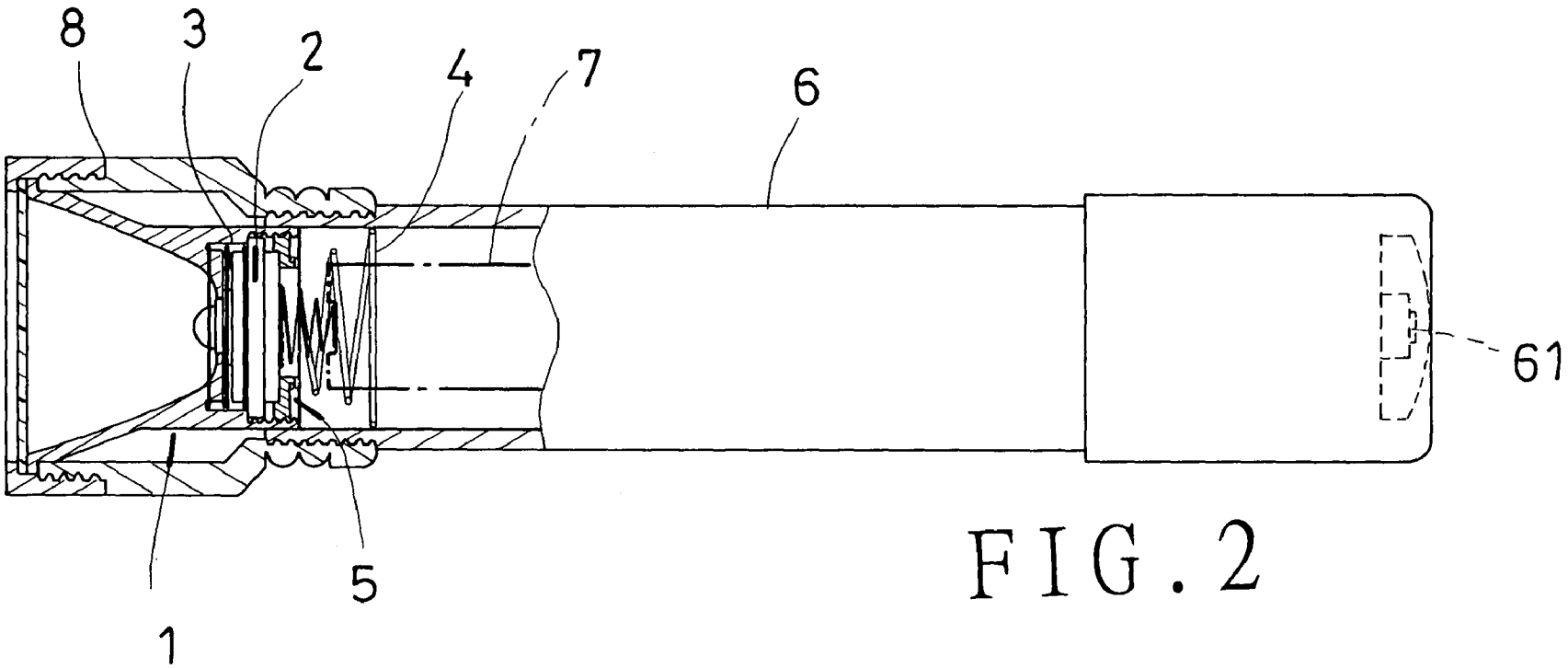
FIG. 2 is a side view of the present invention.
Figure 3:
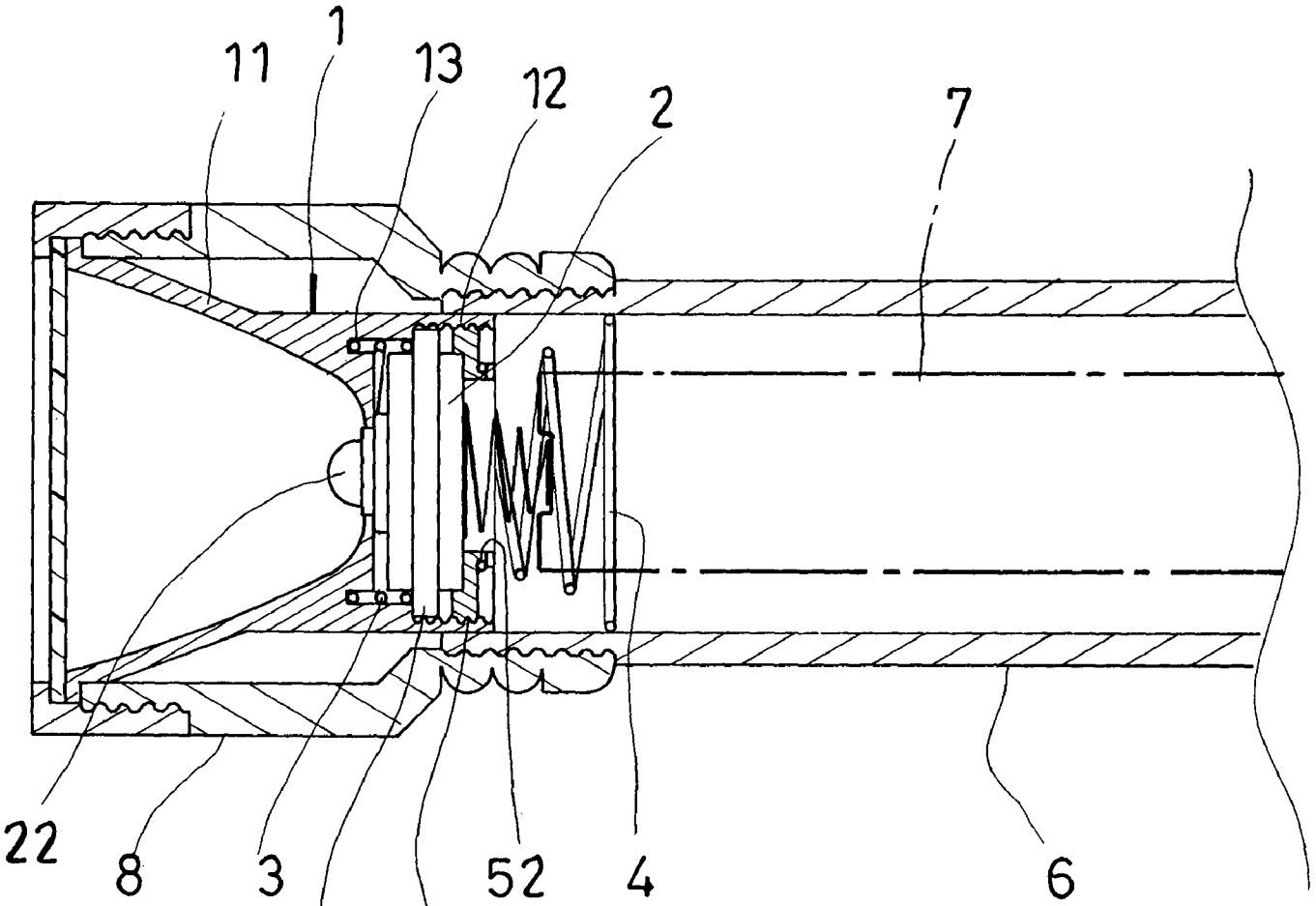
FIG. 3 is a partial sectional view of the present invention (1)

Referring to FIG. 1 to FIG. 3, preferred embodiment of a flashlight of the present invention includes a lamp support 1, an electric light generating mechanism 2, a front heat-conducting component 3, a rear heat-conducting component 4, an adjustment member 5 for adjusting a position of a focal point of light emitted from a light source, a barrel body 6, a power supplying mechanism 7, and a covering member 8.

The lamp support 1 has a light-reflecting cup 11, and a joining part 12; the light-reflecting cup 11 is substantially in the shape of a horn, and adjoins a front end of the joining part 12, and it further communicates with the joining part 12; the joining part 12 has a threaded portion 122 on a rear end thereof, and a locating groove 121 on the front end.

The electric light-generating mechanism 2 is held in the joining part 12 of the lamp support 1, and includes a circuit board 21, and a light source 22 joined on the circuit board 21; the circuit board 21 has a controlling circuit thereon; the light source 22 is a light emitting diode.

The front heat-conducting component 3 is a metallic spring, and is positioned in the joining part 12 of the lamp support 2 with one end thereof being held in the locating groove 121 of the joining part 12, and the other end contacting the circuit board 21 of the electric light-generating mechanism 2 so as to bias the circuit board 21 towards a rear end of the lamp support 1.

The rear heat-conducting component 4 is a metallic spring, and it is propped against the focal distance adjustment member 5 at a front end, and contacts the barrel body 6 at a rear end thereof.

The adjustment member 5 is like a ring. The adjustment member 5 has a threaded portion 51, and an annular groove 52 an outer circumferential side thereof. The adjustment member 5 is threadedly joined on the threaded portion 122 of the rear portion of the lamp support 1 at the threaded portion 51 thereof. Therefore, the front heat-conducting component 3 makes the circuit board 21 of the electric light-generating mechanism 2 constantly contact the adjustment member 5. The front end of the rear heat-conducting component 4 is embedded in the annular groove 52 of the adjustment member 5.

The barrel body 6 is hollow, and has a button switch 61 fitted on a rear end; the button switch 61 is electrically connected to the power supply mechanism 7 as well as the controlling circuit on the circuit board 21 of the electric light-generating mechanism 2 to turn on or turn off the light source 22 of the electric light-generating mechanism 2.

The power supplying mechanism 7 is held in the barrel body 6 to supply electricity to the electric light-generating mechanism 2.

The covering member 8 is positioned around the light-reflecting cup 11 of the lamp support 1, and joined on a front end of the barrel body 6; thus, the lamp support 1 and the electric light-generating mechanism 2 are held in the covering member 8 and the barrel body 6.

Figure 4:
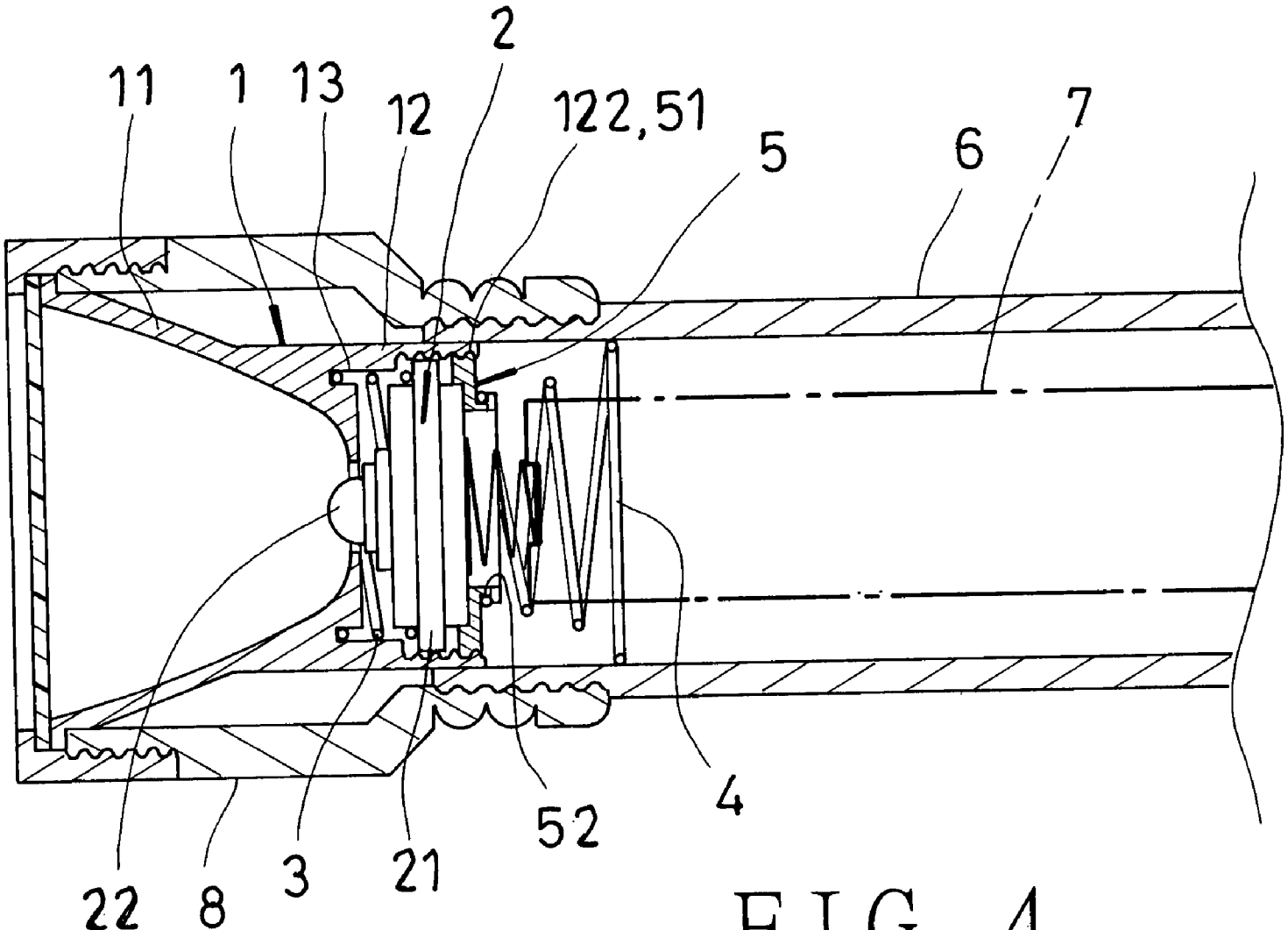
FIG. 4 is a partial sectional view of the present invention (2).

Referring to FIGS. 3 and 4, the adjustment member 5 can be turned to change the position of the electric light-generating mechanism 2 in relation to the lamp support 1 so as to adjust the position of the focal point of light emitted from the light source 22 of the electric light-generating mechanism 2 after the barrel body 6 and the covering member 8 have been separated, and the lamp support 1 taken out; when the adjustment member 5 is turned, the electric light-generating mechanism 2 will move relative to the lamp support 1 together with the adjustment member 5.

Moreover, when the light source 22 is shining, heat produced by the electric light-generating mechanism 2 will be conducted away from the front heat-conducting component 3 to the lamp support 1 as well as from the rear heat-conducting component 4 to the barrel body 6. Thus, heat produced from working of the electric light-generating mechanism 2 can be efficiently dissipated so as not to cause damage or reduce the service life of the light source 22.

In addition, referring to FIG. 1, the adjustment member 5 has two gaps 53 on a rear end thereof, which faces the rear heat-conducting component 4; thus, a suitable tool can be moved to turn the adjustment member 5 after having been engaged in the gaps 53.

From the above description, it can be seen that the present invention has the following advantages:

1. The flashlight of the present invention has the adjustment member, which is threadedly joined on the inner threaded portion of the lamp support, and can be turned to change the position of the electric light-generating mechanism in relation to the lamp support so as to adjust position of the focal point of light emitted from the light source of the electric light-generating mechanism.

2. Heat produced from shining of the light source of the electric light-generating mechanism will be conducted away from the front heat-conducting component to the lamp support as well as from the rear heat-conducting component to the barrel body. Therefore, heat produced from the light source continuing shining for an extended length of time can be dissipated, thus prevented from causing damage to the light source.

What is claimed is:

1. A flashlight, comprising a lamp support; the lamp support having a joining part; the lamp support having a light-reflecting cup adjoining a first end of the joining part; the joining part having a threaded portion on a second end thereof;

an electric light-generating mechanism held in the joining part of the lamp support; the electric light-generating mechanism including a circuit board, and a light source; the circuit board having a controlling circuit thereon;

a front heat-conducting component interposed between the lamp support and the electric light-generating mechanism;

an adjustment member for adjusting a position of a focal point of light emitted from the light source; the adjustment member having a threaded portion on an outer circumferential side thereof; the adjustment member being threadedly joined on the threaded portion of the joining part;

a barrel body; the barrel body being hollow; the barrel body having a button switch fitted on a rear end thereof;

a power supplying mechanism held in the barrel body to supply electricity to the electric light-generating mechanism; the button switch being electrically connected to the power supply mechanism and the controlling circuit on the circuit board of the electric light-generating mechanism;

a rear heat-conducting component interposed between the adjustment member and the barrel body; and a covering member; the covering member being positioned around the light-reflecting cup of the lamp support and joined on the barrel body.

2. The flashlight as claimed in claim 1, wherein the light source is a light emitting diode.

3. The flashlight as claimed in claim 1, wherein the front heat-conducting component is a metallic spring.

4. The flashlight as claimed in claim 3, wherein the joining part of the lamp support has a locating groove on the first end thereof, and one end of the front heat-conducting component is held in the locating groove of the joining part of the lamp support.

5. The flashlight as claimed in claim 1, wherein the rear heat-conducting component is a metallic spring.

6. The flashlight as claimed in claim 5, wherein the adjustment member has an annular groove on an outer circumferential side thereof, and one end of the rear heat-conducting component is embedded in the annular groove of the adjustment member.

7. The flashlight as claimed in claim 1, wherein the adjustment member has a plurality of gaps on one end thereof, which faces the rear heat-conducting component.

8. The flashlight as claimed in claim 1, wherein the joining part of the lamp support has a locating groove on the first end thereof, and one end of the front heat-conducting component is held in the locating groove of the joining part of the lamp support.

9. The flashlight as claimed in claim 1, wherein the adjustment member has an annular groove on an outer circumferential side thereof, and one end of the rear heat-conducting component is embedded in the annular groove of the adjustment member.

* * * * *